358-86 SR
2/14/78 XR 4,073,368

United States Patent [19]
Mustapick
[11] 4,073,368
[45] Feb. 14, 1978

[54] AUTOMATED MERCHANDISING SYSTEM

[76] Inventor: Andrew James Mustapick, 190 Highland Ave., Northport, N.Y. 11768

[21] Appl. No.: 704,449

[22] Filed: July 12, 1976

Related U.S. Application Data

[63] Continuation of Ser. No. 542,225, Jan. 20, 1975, abandoned.

[51] Int. Cl.² ..... E04H 3/04
[52] U.S. Cl. ..... 186/1 C; 358/86; 358/93
[58] Field of Search ..... 186/1 R, 1 C; 358/86 R, 358/93

[56] References Cited

U.S. PATENT DOCUMENTS

| | | | |
|---|---|---|---|
| 2,463,339 | 3/1949 | Wetzel | 186/1 C |
| 3,647,026 | 3/1972 | Alexander | 186/1 C |
| 3,741,345 | 6/1973 | Saridis | 186/1 R |

*Primary Examiner*—Trygve M. Blix
*Assistant Examiner*—Reinhard J. Eisenzopf
*Attorney, Agent, or Firm*—Stephen E. Feldman; Marvin Feldman

[57] ABSTRACT

A plurality of communication stanchions are arranged in a parking lot, spaced one from the other, so that each merchandise customer may park their automobile adjacent a stanchion close enough to be able to use communication equipment carried by the stanchion without leaving the automobile. The communication equipment interconnects with a remote warehouse type market and includes a video receiver which displays for the customer the merchandise available for sale. Keyboard and voice units also interconnected with the warehouse, are provided at the communication stanchion for customer use to transmit to the warehouse a merchandise order. Within the warehouse goods are stored for ready access, either by order clerks, or automatic order picking equipment. The order once picked is tabulated, bagged and forwarded either directly to the stanchion where the customer pays and the order is placed in the customer's automobile or to a central leading area which the customer moves to pay a cashier and have the goods loaded into the automobile.

8 Claims, 7 Drawing Figures

ORDERING UNIT RR
DEPARTMENTS
CEREALS 1
DAIRY 2
DELI 3
VEG. XX
INSTRUCTIONS
1
2
3
4
5
6
7
8
INDICATOR LIGHTS
CODE #
SIZE
QUANTITY
PLEASE WAIT FOR YOUR GOODS
ON
OFF
PLEASE PROCEED TO CASHIER
1 2 3
FOR YOUR GOODS
KEYBOARD
1 2 3 4 5 6 7 8 9 0
HOLD
DEPT
REV
SELECT
CORN FLAKES
1234
CODE 1 2 3
SIZE 2 oz 12 oz 28 oz
PRICE X XX XXX
DISPLAY
DEPT. 1 CEREALS
CODE SIZE QUANTITY
1234 1 1
200
202
204
206
208
210
212
214
216
220
222
224
226
230
232
240
242
250

AUTOMATED MERCHANDISING SYSTEM

This is a continuation, of application Ser. No. 542,225; filed January 20, 1975, now abandoned.

BACKGROUND OF THE INVENTION — FIELD OF THE APPLICATION

This invention relates to automated markets and more particularly to a warehouse type market interconnected to remotely located communications equipment disposed for use by a customer who, without leaving their parked automobile, may order, pay for and receive the goods ordered.

BACKGROUND OF THE INVENTION—DESCRIPTION OF PRIOR ART

Supermarket type shopping is ever present in todays society. It accounts for a majority of the foodstuff and grocery store type items sold, and an ever increasing amount of hardware and other merchandised items.

Conventionally one pictures such a supermarket as having a large parking lot where the customer parks their car and walks, at times through wet, cold, and otherwise inclement weather, to the supermarket building itself. Once inside, the customer pushes a cart aroung aisles and picks from shelves, or other type displays, items which they desire to purchase. Thereafter the customer unloads the cart at a checkout counter where the total price is tabulated and the goods are bagged and returned to the cart. After paying, the customer pushes the cart out into the parking lot and either pushes the cart to the automobile or walks to the automobile and brings same to a loading area; thereafter loading the goods into the automobile.

In such a supermarket the customer not only has to walk a great deal but must also lift the items many times before they finally come to rest in the customers automobile. Many people tire easily from these efforts while others who are old or ill are unable to shop in such an environment no matter how advantageous it may otherwise be.

Restocking is also a problem in a conventional supermarket. If stock is put out on display during normal business hours it interferes with customers who are doing their shopping. If accomplished outside of normal shopping hours, it requires longer hours, a second shift, and attendent extra costs.

Supermarket owners in their ever increasing effort to attract new customers and keep old ones are making their stores larger, are decorating them fancier and fancier, are providing wider aisles and are using nicer types of display equipment. All this increases the store overhead, must in turn be passed on to the customer and in the final outcome increases the price of the goods to the purchaser. These open displays also increase pilferage. Some efforts have been made to relieve the aforementioned problems. Examples of such are shown in United States Letters Pat. No. 1,592,931 for a Store System granted to A. E. Fritsche on July 20, 1926; United States Letters Pat. No. 2,665,775 for a Mechanized Merchandising System granted to C. Smith on Jan. 12, 1954; United States Letters Pat. No. 3,023,851 for an Electronic Marketing System and Apparatus granted to B. V. Stiller on Mar. 6, 1962. However these systems, while relieving the customer of the shopping cart pushing and merchandise handling problems, still require the customer to parade through the parking lot to and from their automobile and still require the customer to walk around the market. The need for a well decorated, customer accomodating shopping area and its associated costs are still present.

Other shopping systems; such as those shown in United States Letters Pat. No. 1,751,199 for a Self Serving Store granted to J. N. Grant on Mar. 18, 1930, and United States Letters Pat. No. 2,638,636 for a Shopping Establishment granted to E. A. Pool on May 19, 1953 teach ways for a customer to shop without leaving their automobile. These however require drive through markets which must be large enough to accomodate not only the goods to be sold but also a large number of automobiles while they drive through during the goods selection process. They present many other obvious problems such as dirt tracked on the vehicles, as well as dangers of exhaust fumes, or the expense of clearing same.

In United States Letters Pat. No. 3,647,026 for Automatic Drive-In Store granted to G. L. Alexander et al on Mar. 7, 1972 the customer does not drive through the market during the merchandise selection process, but the building must still accomodate the many customer vehicles. The goods ordering and order selection equipment of Alexander et al is also quite complex in construction and operation thus greatly adding to the cost of goods sold.

SUMMARY OF THE INVENTION

It is therefore an object of this invention to provide a new and improved merchandising system.

It is another object of this invention to provide a new and improved automated system for supermarket type merchandising.

It is a further object of this invention to provide a new and improved automated system for merchandising groceries, hardware, household goods, building materials and the like.

It is still another object of this invention to provide a new and improved automated merchandising system enabling a customer to remain in their automobile while shopping.

It is still another object of this invention to provide a new and improved automated merchandising system which prevents customers from being in contact with goods on open display and thus reduce pilferage.

It is yet still another object of this invention to provide a new and improved automated merchandising system wherein a customer, through the intermediary of electronic communications equipment, views and orders goods available for sale at a remotely located building, and then pays for and receives same all without leaving their automobile.

This invention involves an automated merchandising system wherein customers may drive their automobiles into a parking area and while remaining in their parked automobiles be apprised of an order desired goods; they can then remain in their automobiles or transact business in other stores and service shops; later paying for and receiving the goods while remaining in their automobiles or upon returning to their automobiles.

In carrying out the invention, according to the preferred embodiment thereof, a goods storage building is located remotely from and electronically interconnected with a parking area. At the parking area a plurality of automobile receiving locations are provided each with a communicator equipped with video means for viewing goods available at the remote building and with keyboard and voice means for transmitting to said remote building a goods order. Goods so ordered are assembled, tabulated and delivered to the customer who receives the same after making payment. The remote building is also equipped to receive supplies of goods and for restocking same to facilitate ongoing operation of the system.

Other objects, features, and advantages of the invention in its details of construction and arrangement of parts, will be seen from the above, from the following description of the preferred embodiment when considered in conjunction with the drawings and from the appended claims.

DESCRIPTION OF THE PREFERRED EMBODIMENT

For convenience, the invention will be described as applied to a supermarket of the type from which food and other grocery type items are purchased and which consists of a storage building, for housing the items and from which they are dispensed by either clerks or a combination of clerks and automated equipment, and a plurality of remote stations next to which the customer parks his automobile and at which there is located a communicator equipped with a video unit for viewing the goods and keyboard and voice units for use by the customer in ordering goods as well as attendent other controls; it being understood, nevertheless, that without departing from the scope of this invention that subject automated merchandising system may be utilized for markets which sell hardware and home building supplies, for toy stores, for 5 and 10 type stores, or for that matter any store which sells a number of different types of goods; that the communicator may utilize other means of displaying goods for sale; and that the communicator may utilize only keyboard on only voice units for ordering goods or, for that matter, any other conventionally available system to provide a signal as to which goods and how many thereof are being ordered.

Figure 1:
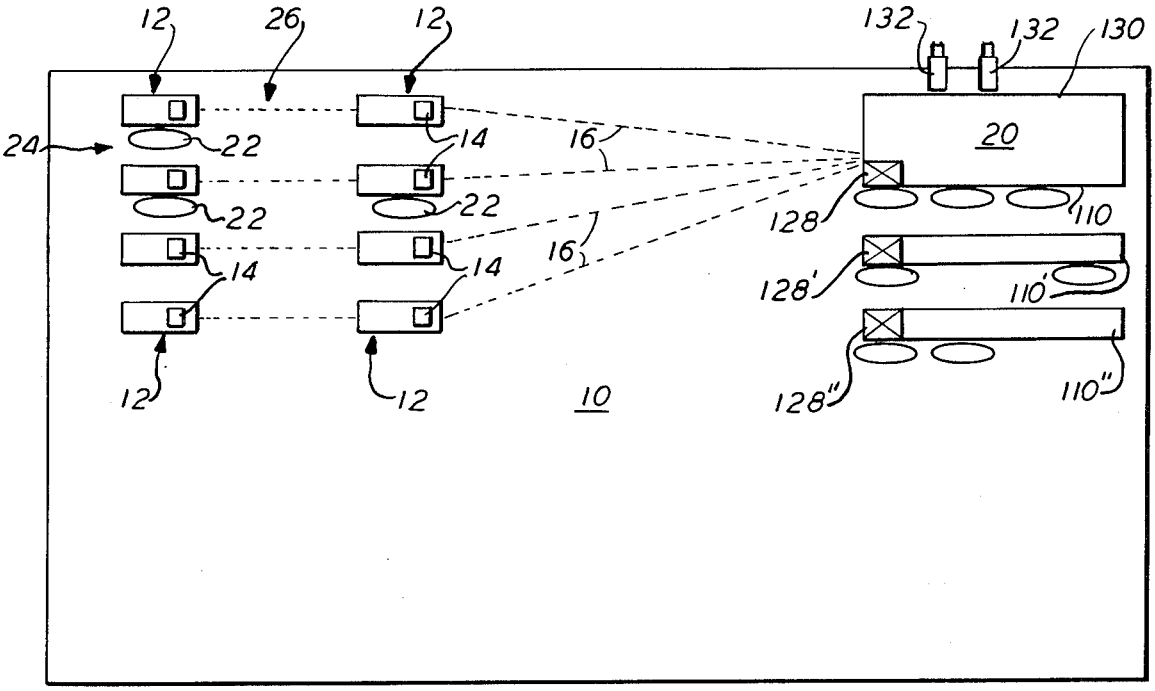
FIG. 1 is a schematic of a market parking lot showing a goods storage building and a plurality of individual automobile parking areas with attendent communication equipment all incorporating the instant invention.
Figure 2:
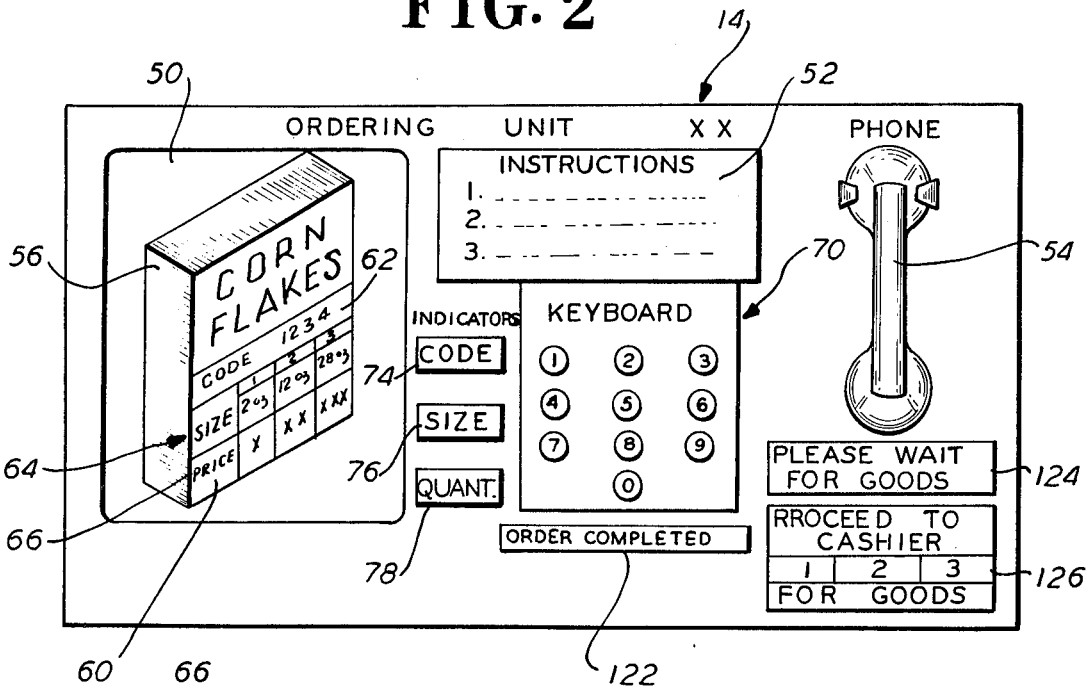
FIG. 2 is a schematic of an ordering unit one of which is disposed at each automobile parking area of FIG. 1 and all of which incorporate the instant invention.

With reference to FIG. 1 there is generally shown at 10 a parking lot within which there are disposed a plurality of communications stanchions 12 each carrying an ordering unit 14 (FIGS. 1 and 2) interconnected by electrical conductor means 16 to a goods storage building 20 (FIGS. 1 and 3) remotely disposed from stanchions 12. Parking lot 10 may either be devoted solely to the operation of goods storage building 20 or it may be part of a larger lot serving a shopping center with other stores. As part of a center with more than one store, building 20 may be either part of the main set of stores or it may be remotely located therefrom as a stand alone structure.

Stanchions 12 (FIG. 1) are arrayed in lot 10 so that an automobile 22 may be parked adjacent each stanchion 12 with the driver of the automobile having easy access to ordering unit 14 carried by the stanchion 12. Suitable automobile drive lanes 24, 26 are provided in lot 10 to permit movement of an automobile into position adjacent any particular stanchion 12 and away from the stanchion 12 without interfering with or having to wait for an automobile parked adjacent any other stanchion 12.

Figure 4:
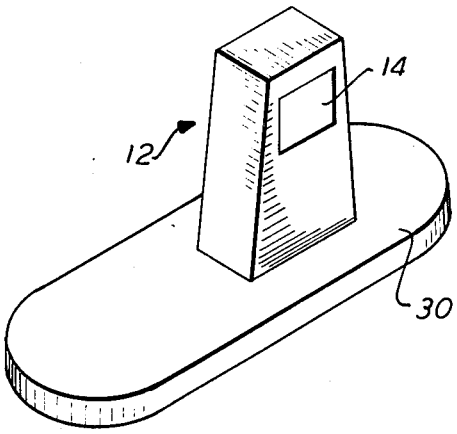
FIG. 4 is a perspective view of a communications stanchion incorporating the instant invention.
Figure 5:
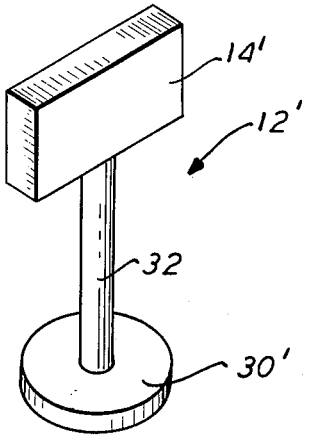
FIG. 5 is a perspective view of an alternative form of communications stanchion incorporating the instant invention.

Stanchion 12 (FIGS. 1 and 4) may be formed as a box like structure within which is housed ordering unit 14. A suitable island 30, formed from concrete or like material, may also be provided to protect stanchion 12 from being struck by an automobile. Alternatively a stanchion 12' may be utilized wherein ordering unit 14' is mounted on top of a post 32 which is in turn surrounded by a suitable island 30' formed from concrete or other suitable building material. Ordering units 14, 14' are disposed on their respective stanchions 12, 12' so that the driver of an automobile parked adjacent thereto may have easy access to the controls disposed thereon. If desired ordering unit 14, 14' may be mounted on their respective stanchions 12, 12' for removal therefrom and placement within the automobile parked adjacent thereto for operation thereof. Suitable cable means (not shown) with appropriate slack must be provided to interconnect ordering units 14, 14' with conductor means 16 to facilitate movement of ordering units 14, 14' into the automobile.

Figure 6:
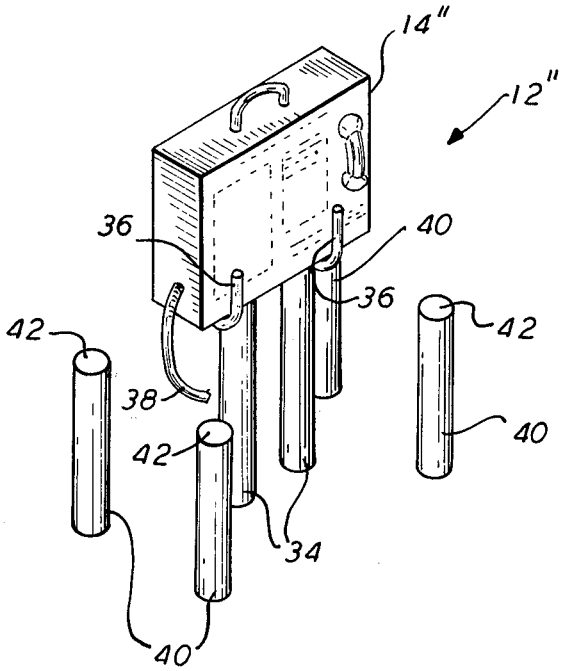
FIG. 6 is a perspective view of still another alternative form of communications stanchion incorporating the instant invention.

One further form of stanchion 12'' is shown in FIG. 6. A pair of posts 34 supported a cradle 36 adapted to receive ordering unit 14''. Cable means 38 interconnected unit 14'' with conductor means 16 in such a way as to permit movement of unit 14'' from cradle 36 and into the automobile parked adjacent thereto. A number of pipes 40, filled with concrete 42, are disposed about stanchion 12'' to act as a safety barrier and protect stanchion 12'' from being struck by an automobile. If prepared "I" beams, set into the ground, may be used to form the barrier instead of pipes 40.

Each ordering unit 14, (FIGS. 1, 2 and 4) includes a video display 50 which shows the customer parked in automobile 22 (FIG. 1) adjacent stanchion 12 the goods available at storage building 20. Obviously the customer may either be the driver of automobile 22 or a passenger properly seated therein to operate ordering unit 14.

Ordering unit 14 may either remain on stanchion 14 to be operated by the customer from the automobile by reaching through the open car window, or it may be, if so constructed, removed from stanchion 12 and brought into the automobile to be operated therein. In the latter case suitable conductor means must be provided to permit such movement while still interconnecting ordering unit 14 to conductor means 16.

The user of ordering unit 14, pursuent to the instructions 52 displayed thereon, first renders the unit operative by either actuating a conventional on/off switch or if preferred by the market by contacting a person in building 20 on a voice phone 54 connected to building 20 over conventional voice lines, to request that ordering unit 14 be rendered operative.

Once ordering unit 14 is rendered operative all goods available for sale will appear one after the other on video display 50. This is accomplished by either conventional closed circuit video transmission of items on display at building 20 using one or more video pickups which scan the goods in proper succession. Alternatively the transmission may be from prerecorded video tape conventionally integrated into the system. The goods, one of which appears at 56 on video display 50, are serially arrayed by department, such as cereals, dairy, juices, vegetables, etc. to facilitate customer purchase. Any other arrangement deemed more suitable by the proprietor may be used.

The goods 56 so displayed have secured thereto a label 60 upon which is shown: a code number 62 peculiar to the item; a list 64 of available sizes; and prices 66 corresponding to the prices. Label 60 may also appear in video display as a placard separate from the goods, or as a separate display electronically generated by suitable and conventionally available means (not shown).

Goods 56 will appear on video display 50 for a period of time sufficient for the customer to operate a keyboard 70 (FIG. 2) to transmit his order to building 20. Keyboard 70 is a conventional 10 key type and is interconnected over conductor means 16 to conventionally available data storage means 72 (FIG. 3) in building 20. A number of indicator lights 74, 76, 78 may be associated with keyboard 70 to assist the customer. Lights 74, 76, 78 are conventionally interconnected as on commercially available point-of-sale terminals to guide the user in entering instructions in proper order. As each item 56 appears on display 50 indicator light 74 requesting the customer to enter the code number "1234" will light up. Thereafter the "size" light 76 will light up and the customer will enter the size number 1, 2, or 3. Lastly the "quantity" light 78 will illuminate and the customer will enter the desired number of goods 56 they desire to purchase. Lights 74, 76, 78 may be eliminated in lieu of proper instructions advising the customer how to enter the order for the goods.

The order generated by the customer is transmitted to data storage means 72 (FIG. 3) in goods storage building 20 over conductor means 16 (FIG. 1). Goods storage building 20 (FIG. 3) may be constructed as the simplist of structures in warehouse type construction. The goods 56 are arranged in building 20 in racks or shelves 90 for easy access or picking by an order clerk 92.

Racks 90 may be set up by department or in any other manner desired. Orders received by data storage means 72 are in turn transmitted to and printed out on printers 94 associated with the racks upon which the particular goods 56 are stored. Alternatively the print out may be singularly located at data storage means 72 and hand distributed to order clerks 92. Each print out will be marked to correspond to the ordering unit 14 from which the order was transmitted.

As order clerk 92 picks the order the goods 56 included in same are placed in a collecting tub or basket 96 which the order clerk pushes, or which is otherwise conveyed along an order picking line 98. Line 98 may merely be a smooth surface along which basket 96 is pushed or it may be a slow moving conveyor of conventional design. Collecting tub 96 is either marked to indicate the ordering unit 14 or order clerk 92 may merely place the order print out therein.

Figure 3:
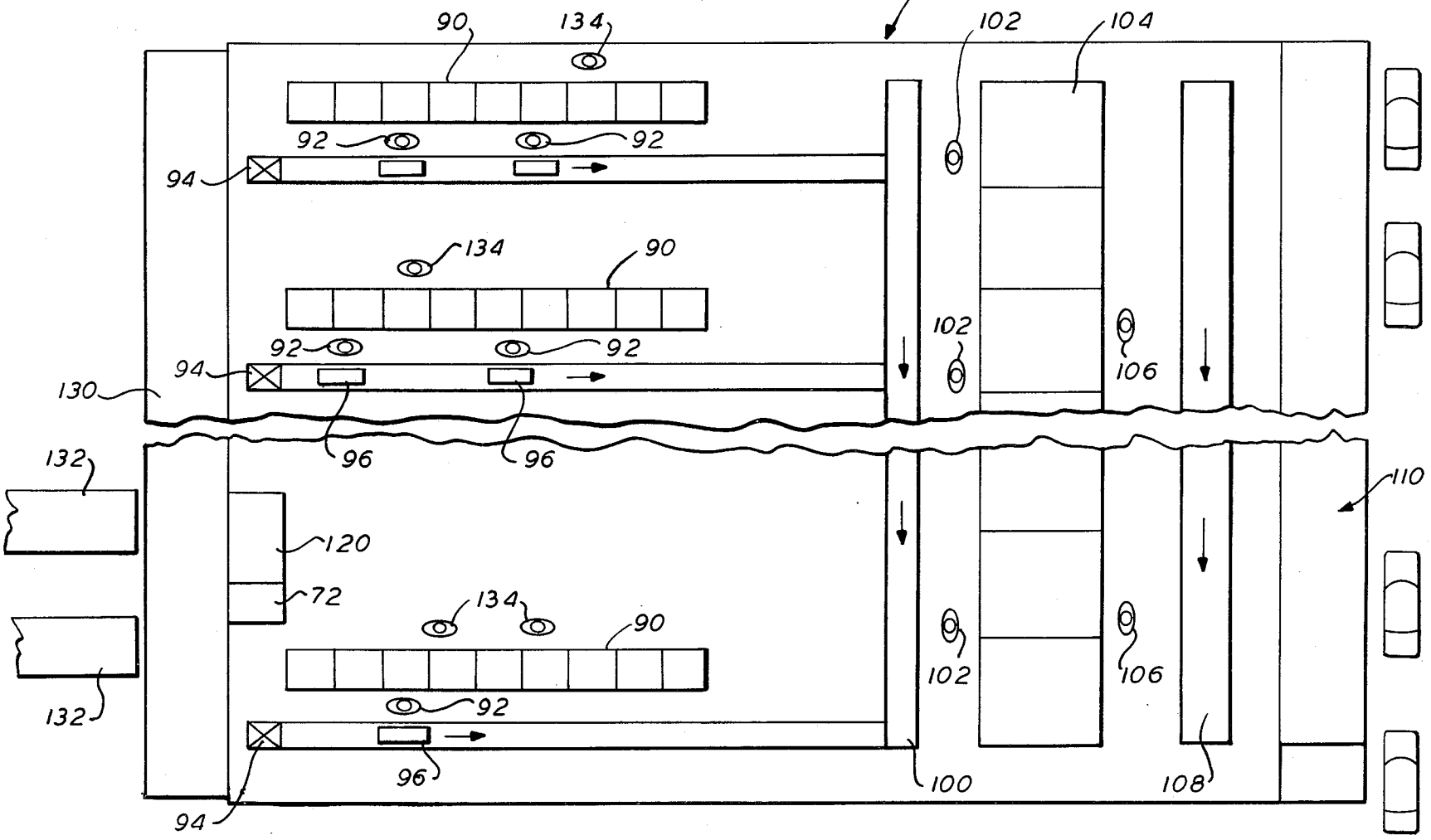
FIG. 3 is a schematic plan of the goods storage building of FIG. 1 incorporating the instant invention.

Each collecting tub 96 then proceeds to an order assembly line 100 where assembly clerks 102 stack them in assembly racks 104 according to ordering unit. When the order is complete baggers 106 collect and bag the entire order and transport same via a shipping line 108 to a loading platform 110 (FIGS. 1 and 3).

The customer may complete his order over keyboard 70. If in a hurry, if the order is short, or if the customer desires special items such as cuts or quantities of meat or deli they may use the voice line 54 which interconnects with a customer service area 120, in building 20. The clerks at customer service area 120 transmit the voice order to the appropriate department or departments and it is thereafter assembled and either combined with any portion of the order transmitted by keyboard 70 or sent direct to loading platform 110.

Upon completion of the order the customer depresses order complete key 122. This action initiates bagging of the order and compilation of a register tape or bill in any other desired format. Depending upon how crowded the leading platforms 110, 110', 110" (FIG. 1) are the customer will be advised by indicator lights 124, 126, (FIG. 2) to either wait where they are parked or proceed to a particular cashier 128, 128' 128". If the customer remains parked at stanchion 12 a clerk will bring out the order, collect the bill and place the order in the customer's automobile. Otherwise the customer will proceed to the designated cashier to pay for the goods and then move up to an empty space at loading platform to receive the bagged order.

Building 20 is also provided with a goods receiving area 130 where trucks 132 may park to unload. Once unloaded goods 56 may either be stored or sent directly to appropriate racks 90 where stocking clerks 134 may restock racks 90 while order clerks 92 are making up orders. Alternatively, some orders could be filled direct from tractor trailors without having to unpack the trailer.

Racks 90 may be either entirely or partially constructed to provide for automated order picking in response to data transmitted thereto from data storage means 72. As such conventionally available order picking and assembling equipment would be utilized.

Figure 7:
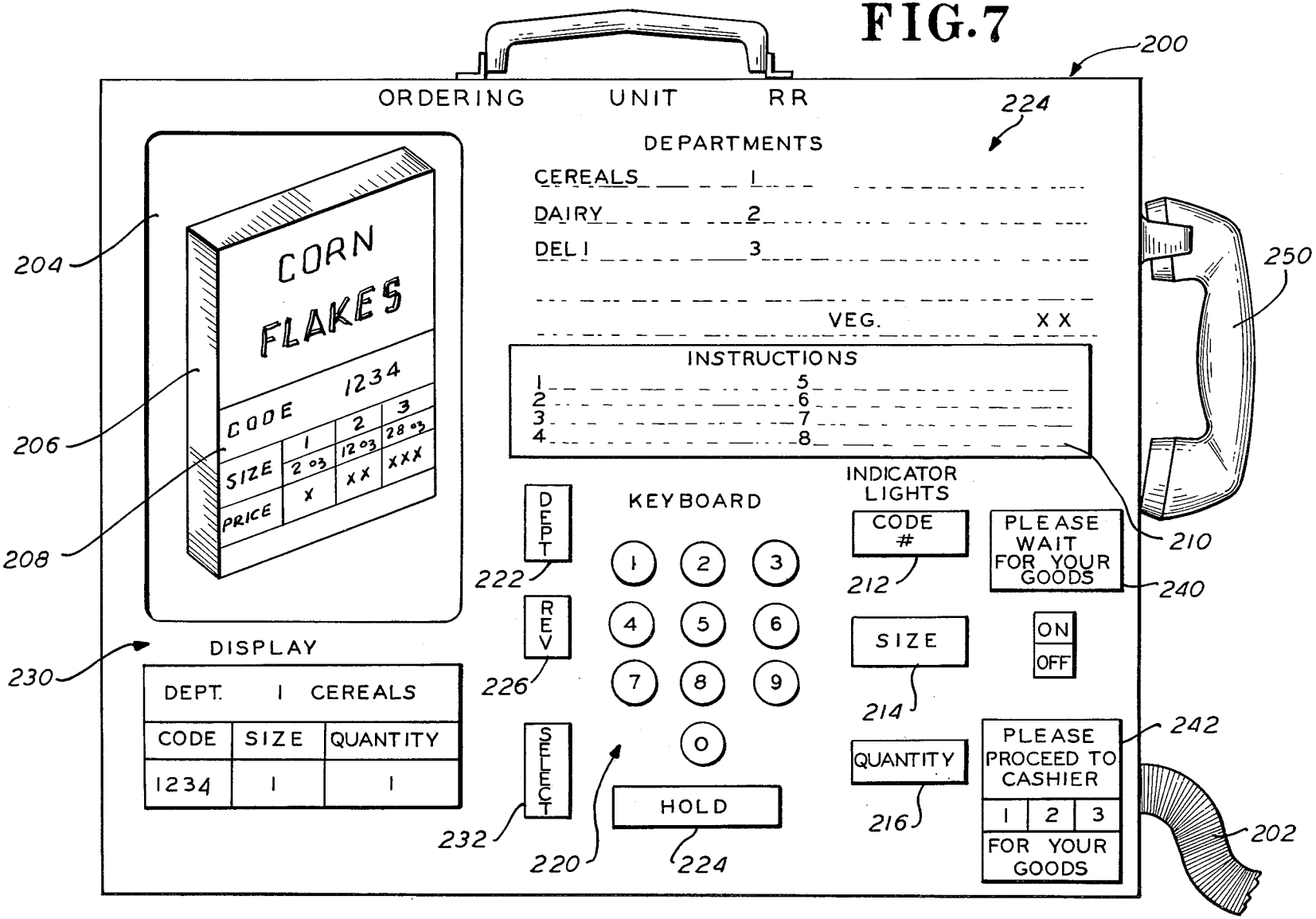
FIG. 7 is a schematic of an alternative form of ordering unit, of the type shown in FIG. 2, one of which is disposed at each automobile parking area of FIG. 1 and all of which incorporate the instant invention.

FIG. 7 shows a more sophisticated ordering unit 200 connected over appropriate lines 202 to a data storage means (not shown) housed in building 20 and similar to data storage means 72. A video display 204 shows the goods 206 one after the other and also shows a label with the code number for the goods as well as codes for size and respective prices. Appropriate instructions appear at 210 on ordering unit 200.

Here again video display 204 may respond to one or more closed circuit video transmitters successively scanning the goods. Or alternatively and preferably the video picture may be generated by transmission from pre-recorded video tapes.

Indicator lights 212, 214, 216 still advise the customer what data to key into keyboard 220. But keyboard 220 also includes a "Dept." key 222, which through appropriate circuitry, permits the customer to switch to any one of the departments listed at 224. Following operation of department key 222, and entry of the appropriate department number into keyboard 220 video display 204 will successively show the goods in the particular department. This operation will facilitate ordering by a customer who does not desire to view all the goods available at building 20.

If the customer desires to think about an item he then may activate a hold key 224 and if they want to go back to an item which they previously passed they may merely depress the reverse key 226.

A verification display 230 is also provided which shows the code, size, and quantity digits entered into keyboard 220 and a select key 232 is provided for activation by the operator to effect entry of the item ordered once so verified.

Instruction lights 240 and 242 are utilized to advise the customer whether they should wait for their goods or proceed to a particular cashier. A telephone 250 is also provided for voice communication.

From the above description it will thus be seen that a novel and improved automated merchandising system has been provided, which system enables a customer to remain in their parked car while viewing, and ordering goods available for sale and while paying for and receiving same.

It is understood that although I have shown the preferred form of my invention that various modifications may be made in the details thereof without departing from the spirit as comprehended by the following claims:

I claim:

1. An automated merchandising system comprising:

a goods storage building;

a plurality of communications stanchions arranged outside of and remote from said goods storage building but electrically and electronically interconnected therewith;

said communications stanchions being spaced one from the other a distance sufficient to permit an automobile to be parked adjacent thereto;

a goods ordering unit carried by each of said communications stanchions so as to be electrically and electronically interconnected therewith and through said communications stanchion to said goods storage building wherein said goods ordering units are removable from their respective stanchions and into the automobile parked adjacent thereto while still remaining electrically and electronically interconnected to said goods storage building; and each said goods ordering unit being accessable to an occupant of an automobile when parked adjacent said communications stanchion and being provided with video display means operable by the customer to display goods available at said goods storage building and data transmission means to transmit to said goods storage building data indicative of goods which the automobile occupant desires to obtain.

2. The merchandising system of claim 1 wherein said display means are activated in response to pre-recorded video tape transmission means housed in said goods storage building.

3. The merchandising system of claim 1 wherein said data transmission means includes keyboard means and voice communication means.

4. The merchandising system of claim 1 wherein data storage means, housed within said goods storage building is electrically and electronically interconnected with said communications stanchions to receive data transmitted from said ordering unit and to compile a goods order in response thereto.

5. The merchandising system of claim 4 wherein goods, stored in said goods storage building, are selected by order picking means in response to said goods order compiled by said data storage means; to be thereafter assembled by order assembly means and delivered to the customer.

6. The merchandising system of claim 5 including indicator means carried by said goods ordering means for advising the customer to remain parked at the stanchion for goods delivery and payment.

7. The merchandising system of claim 6 wherein said indicating means may selectively advise the customer to proceed to a designated area for goods payment and pick-up.

8. The merchandising system of claim 1 wherein said goods storage building includes goods receiving means and means for restocking the goods for future order picking.

* * * * *